US007939742B2

(12) United States Patent
Glaser

(10) Patent No.: US 7,939,742 B2
(45) Date of Patent: May 10, 2011

(54) MUSICAL INSTRUMENT WITH DIGITALLY CONTROLLED VIRTUAL FRETS

(76) Inventor: Will Glaser, Berkeley, CA (US)

( * ) Notice: Subject to any disclaimer, the term of this patent is extended or adjusted under 35 U.S.C. 154(b) by 166 days.

(21) Appl. No.: 12/378,622

(22) Filed: Feb. 19, 2009

(65) Prior Publication Data

US 2010/0206157 A1 Aug. 19, 2010

(51) Int. Cl.
*G10H 1/00* (2006.01)

(52) U.S. Cl. ..... 84/615; 84/653; 84/600

(58) Field of Classification Search ..... 84/600–602, 84/615, 653

See application file for complete search history.

(56) References Cited

U.S. PATENT DOCUMENTS

| | | | | | |
|---|---|---|---|---|---|
| 1,661,058 | A | * | 2/1928 | Theremin | 84/674 |
| 3,749,810 | A | * | 7/1973 | Dow | 84/701 |
| 4,438,674 | A | * | 3/1984 | Lawson | 84/701 |
| 4,524,348 | A | * | 6/1985 | Lefkowitz | 341/5 |
| 4,526,078 | A | * | 7/1985 | Chadabe | 84/602 |
| 4,716,804 | A | * | 1/1988 | Chadabe | 84/653 |
| 4,776,253 | A | * | 10/1988 | Downes | 84/645 |
| 4,968,877 | A | * | 11/1990 | McAvinney et al. | 250/221 |
| 4,980,519 | A | * | 12/1990 | Mathews | 178/19.01 |
| 5,017,770 | A | * | 5/1991 | Sigalov | 250/221 |
| 5,045,687 | A | * | 9/1991 | Gurner | 250/221 |
| 5,081,896 | A | * | 1/1992 | Hiyoshi et al. | 84/600 |
| 5,107,746 | A | * | 4/1992 | Bauer | 84/626 |
| 5,166,463 | A | * | 11/1992 | Weber | 84/600 |
| 5,170,002 | A | * | 12/1992 | Suzuki et al. | 84/600 |
| 5,177,311 | A | * | 1/1993 | Suzuki et al. | 84/600 |
| 5,192,823 | A | * | 3/1993 | Suzuki et al. | 84/600 |
| 5,290,964 | A | * | 3/1994 | Hiyoshi et al. | 84/600 |
| 5,338,891 | A | * | 8/1994 | Masubuchi et al. | 84/600 |
| 5,369,270 | A | * | 11/1994 | Gurner et al. | 250/221 |
| 5,373,096 | A | * | 12/1994 | Suzuki et al. | 84/600 |
| 5,414,256 | A | * | 5/1995 | Gurner et al. | 250/221 |
| 5,442,168 | A | * | 8/1995 | Gurner et al. | 463/36 |
| 5,459,312 | A | * | 10/1995 | Gurner et al. | 250/221 |
| 5,475,214 | A | * | 12/1995 | DeFranco et al. | 250/221 |
| 5,541,358 | A | * | 7/1996 | Wheaton et al. | 84/645 |
| 5,763,804 | A | * | 6/1998 | Rigopulos et al. | 84/635 |
| 5,808,219 | A | * | 9/1998 | Usa | 84/600 |
| 5,875,257 | A | * | 2/1999 | Marrin et al. | 382/107 |
| 5,920,024 | A | * | 7/1999 | Moore | 84/609 |
| 5,990,880 | A | * | 11/1999 | Huffman et al. | 345/660 |
| 5,998,727 | A | * | 12/1999 | Toba et al. | 84/724 |
| 6,066,794 | A | * | 5/2000 | Longo | 84/626 |
| 6,137,042 | A | * | 10/2000 | Kurtzberg et al. | 84/477 R |
| 6,150,600 | A | * | 11/2000 | Buchla | 84/688 |
| 6,222,465 | B1 | * | 4/2001 | Kumar et al. | 341/20 |
| 6,297,438 | B1 | * | 10/2001 | Por Paul | 84/600 |
| 6,388,183 | B1 | * | 5/2002 | Leh | 84/645 |
| 6,492,775 | B2 | * | 12/2002 | Klotz et al. | 315/120 |
| 6,506,969 | B1 | * | 1/2003 | Baron | 84/609 |
| 6,628,265 | B2 | * | 9/2003 | Hwang | 345/156 |
| 6,794,568 | B1 | * | 9/2004 | Callaway | 84/724 |

(Continued)

FOREIGN PATENT DOCUMENTS

JP 2004086118 A * 3/2004

(Continued)

*Primary Examiner* — David S. Warren

(57) ABSTRACT

A musical instrument that can play notes and scale tones without physically touching the device. Microprocessor control, and its associated DSP functionality, permit designer and performer to determine fine musical characteristics and virtual frets resulting in a pleasant and playable digital Theremin. Control over key, scale, octave, slew, snap and other characteristics are provided.

13 Claims, 3 Drawing Sheets

U.S. PATENT DOCUMENTS

| | | | | |
|---|---|---|---|---|
| 6,897,779 | B2 * | 5/2005 | Nishitani et al. | 340/573.1 |
| 6,960,715 | B2 * | 11/2005 | Riopelle | 84/725 |
| 7,012,182 | B2 * | 3/2006 | Nishitani et al. | 84/609 |
| 7,028,547 | B2 * | 4/2006 | Shiratori et al. | 73/495 |
| 7,199,301 | B2 * | 4/2007 | Prittwitz | 84/615 |
| 7,381,884 | B1 * | 6/2008 | Atakhanian | 84/723 |
| 7,402,743 | B2 * | 7/2008 | Clark et al. | 84/615 |
| 7,474,197 | B2 * | 1/2009 | Choi et al. | 340/384.7 |
| 7,504,577 | B2 * | 3/2009 | Riopelle | 84/723 |
| 7,518,055 | B2 * | 4/2009 | Zartarian | 84/615 |
| 7,569,762 | B2 * | 8/2009 | Baum et al. | 84/626 |
| 7,598,449 | B2 * | 10/2009 | Sullivan | 84/646 |
| 7,655,856 | B2 * | 2/2010 | Nakamura | 84/645 |
| 7,678,983 | B2 * | 3/2010 | Komori et al. | 84/600 |
| 7,723,604 | B2 * | 5/2010 | Bang et al. | 84/615 |
| 2001/0035087 | A1 * | 11/2001 | Subotnick | 84/600 |
| 2002/0170413 | A1 * | 11/2002 | Nishitani et al. | 84/600 |
| 2003/0066414 | A1 * | 4/2003 | Jameson | 84/741 |
| 2003/0159567 | A1 * | 8/2003 | Subotnick | 84/626 |
| 2003/0167908 | A1 * | 9/2003 | Nishitani et al. | 84/723 |
| 2004/0000225 | A1 * | 1/2004 | Nishitani et al. | 84/610 |
| 2004/0020348 | A1 * | 2/2004 | Ishida et al. | 84/609 |
| 2004/0163527 | A1 * | 8/2004 | Kawai et al. | 84/603 |
| 2005/0126374 | A1 * | 6/2005 | Ludwig | 84/661 |
| 2006/0185502 | A1 * | 8/2006 | Nishitani et al. | 84/615 |
| 2006/0220882 | A1 * | 10/2006 | Makino | 340/573.1 |
| 2006/0243120 | A1 * | 11/2006 | Takai et al. | 84/612 |
| 2007/0000374 | A1 * | 1/2007 | Clark et al. | 84/724 |
| 2007/0012167 | A1 * | 1/2007 | Bang et al. | 84/723 |
| 2007/0028749 | A1 * | 2/2007 | Basson et al. | 84/601 |
| 2007/0039450 | A1 * | 2/2007 | Ohshima et al. | 84/616 |
| 2007/0084331 | A1 * | 4/2007 | Haken | 84/600 |
| 2007/0175321 | A1 * | 8/2007 | Baum et al. | 84/737 |
| 2007/0175322 | A1 * | 8/2007 | Baum et al. | 84/737 |
| 2008/0000344 | A1 * | 1/2008 | Komori et al. | 84/609 |
| 2008/0250914 | A1 * | 10/2008 | Reinhart et al. | 84/645 |
| 2008/0289482 | A1 * | 11/2008 | Nakamura | 84/645 |
| 2009/0288548 | A1 * | 11/2009 | Murphy et al. | 84/645 |
| 2009/0314157 | A1 * | 12/2009 | Sullivan | 84/646 |

FOREIGN PATENT DOCUMENTS

| | | | |
|---|---|---|---|
| JP | 2005037758 | A * | 2/2005 |
| JP | 2008076765 | A * | 4/2008 |

* cited by examiner

MUSICAL INSTRUMENT WITH DIGITALLY CONTROLLED VIRTUAL FRETS

FIELD OF INVENTION

This invention relates to electronic musical instruments and, in particular, to the improved controllability of musical instruments with analog inputs.

BACKGROUND OF THE INVENTION

In the early part of the 20th century, Leon Theremin built a musical instrument whos pitch and volume could be controlled simply by waving one's hands around the device. U.S. Pat. No. 1,661,058 to Theremin (1928) describes this instrument. Since that time, a handful of refinements to the initial vacuum-tube design have been made to incorporate the evolving state of the art in the electronics circuitry. The device was redesigned around the silicon transistor and then again to take advantage of advancements in integrated circuit technology. Although each of these successively more modern designs has incorporated a different set of individual components, the basic mode of operation has remained largely unchanged. This class of musical instruments has come to collectively be known as "Theremins".

Over time, the eerie sounds generated by these quirky instruments, together with their dramatic stage presentation, have attracted an avid cult following. Widely distributed Theremin performances can be heard in the Beach Boy's recording of the song "Good Vibrations" and as background music in any number of cheesy older horror movies.

Despite the broad enthusiasm however, there are surprisingly few accomplished Theremin practitioners or performers who are able to sustain an extended melody. Additionally, many of the followers of current Theremins complain about persistent problems encountered when working with the devices:

(1) Theremins are very difficult to build and maintain. In particular, many of the current Theremin designs require ongoing fine tuning by a technician familiar with the electronics' internal operation. Most Theremins are quite sensitive to temperature and humidity fluctuations and require frequent manual recalibration.

(2) Perhaps most importantly, current Theremins are incredibly difficult for the casual musician to play. Even accomplished musicians struggle to consistently perform moderately complex melodies on current Theremins. Current Theremins have no distinct keys, notes, or frets and a performer's command of "perfect pitch" is all but required to generate even a single desired note from a Theremin. This great chasm between interest in the instrument and ability to acquire the necessary skill to use one has begged for a solution virtually since its introduction.

SUMMARY OF THE INVENTION

In accordance with the present invention, digital control and its associated functionality is included between the sensing section and the audio generation section of a conventional Theremin design.

Such an arrangement preserves much of what has made the Theremin so compelling for so long while introducing features that make it much easier to use. These improvements use knowledge of musical composition to enable the instrument to play only those notes most appropriate for a given composition. Many of these features are enabled by the introduction of digital signal processing (DSP) capability between the sensor input and audio output of the device.

BRIEF DESCRIPTION OF THE DRAWINGS

In the drawings of an illustrative embodiment, closely related figures may have the same number but different alphabetic suffixes.

DETAILED DESCRIPTION

In accordance with the present invention, digital control and its associated functionality is included between the sensing section and the audio generation section of a conventional Theremin design to provide a functional analog to guitar frets in mid-air.

Conventional Theremins connect some form of sensing mechanism directly to some form of output generator, often using a heterodyning mixer to create an audio frequency output. This works fine for what it is, but has the limitations described above. Theremin 1 includes a control mechanism in the form of CPU 22 in between sensor section 10 and output audio generator 24 providing advantages not previously realized. The DSP software controlling processing by CPU 22 provides unprecedented control over the nature of the resulting sound.

In many cases, the added functionality has the effect of limiting the number of audio frequencies that the instrument is able to make. While, upon initial contemplation, this may seem counterintuitive as an advance, it is actually desirable in aiding the performer to produce music. An analogy can be made to the introduction of frets on the guitar that limit the notes that it may produce; but at the same time, make it much easier to play. The guitar fret was a similar innovation in that it solved a longstanding need with a then novel solution. However, no one has yet been able to create frets in mid-air.

Figure 1:
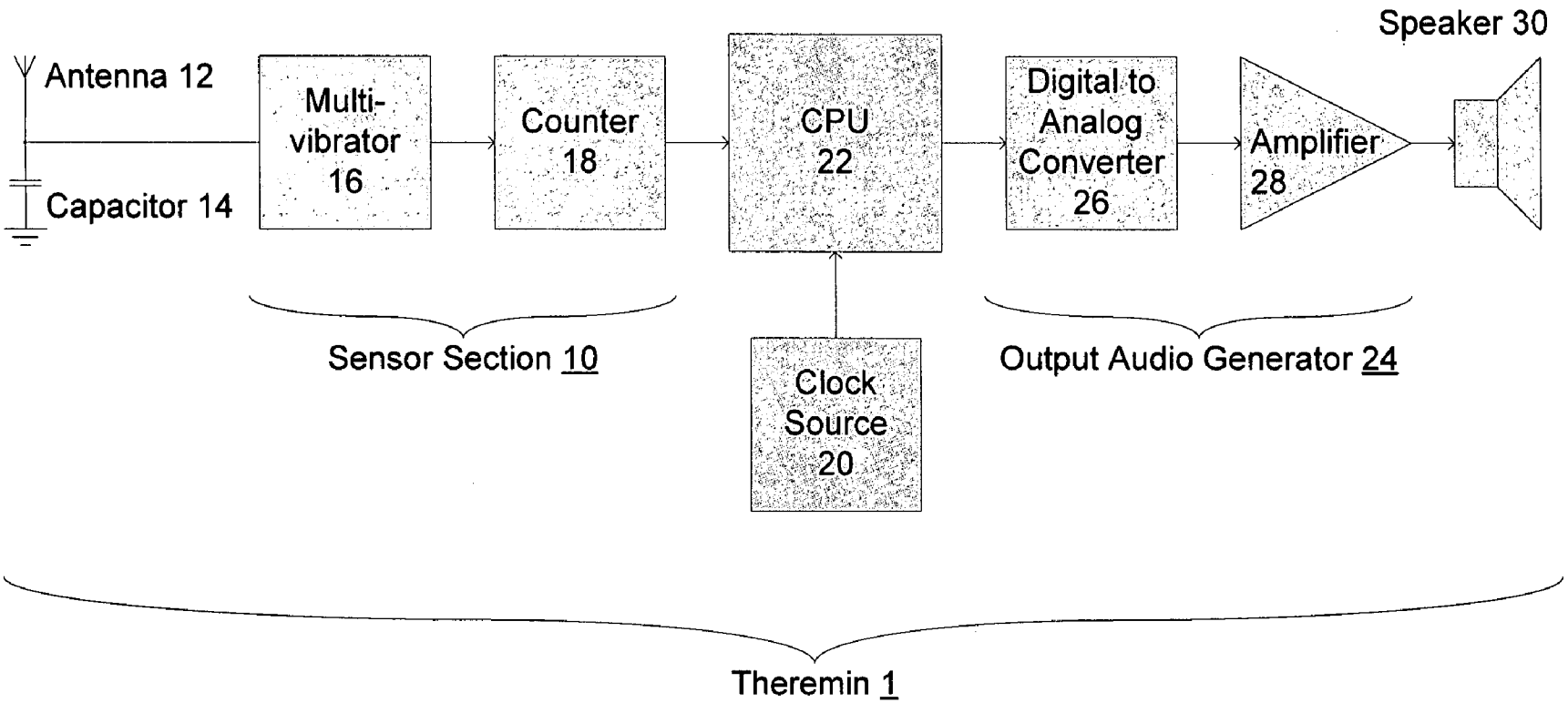
FIG. 1 is a block diagram of the electronic components of a Theremin in accordance with the present invention.

Overview of FIG. 1, Electronics

FIG. 1 is a block diagram of the electronic components of a Theremin 1 in an illustrative embodiment of the invention. There are three main sections: (i) the sensor section, (ii) the processing section, and (iii) the output section. Sensor section 10 generates a position signal that is indicative of the position of a musician's hand with respect to antenna 12. CPU 22 receives that position signal and generates an output signal therefrom based on musical settings held within CPU 22. Output audio generator 24 receives that output signal from CPU 22 and generates a corresponding audio signal that has frequency and amplitude characteristics capable of producing audio sounds through conventional loudspeakers or other audio devices.

Operation

During operation, CPU 22 of Theremin 1 reads sensor 10 and determines hand position. In this illustrative embodiment, CPU 22 acts in accordance with programming included in non-volatile memory therein or, alternatively, attached non-volatile memory. Such programming includes a number of parameters that define a relationship between a musician's detected hand position and corresponding sound to be played. Once CPU 22 determines the position of the musician's hand, CPU 22 consults a table of musical characteristics and determines which note is to be played according to the detected hand position and stored musical characteristics. CPU 22 conveys the determined note to output audio generator 24. Musical characteristics include such settings as Key, Fine pitch, Octave, Range, Scale, Snap, Slew rate, and Waveform.

The Key setting specifies the musical key in which Theremin 1 plays. For example: if the Key setting specifies a key of B, CPU 22 matches notes to detected hand positions so as to play in the musical key of B.

The Fine pitch setting specifies audio frequencies for various hand positions in a given key. For example, the Fine pitch setting can specify that A4 corresponds to the audio frequency of 440 Hz, 435 Hz, or as some other value.

The Octave setting specifies the basic octave of output notes of Theremin 1. For example, the Octave setting can be set such that the central note of Theremin 1 is A3 (220 Hz), or A5 (880 Hz) if a higher register is desired. Any could be chosen as the center of the musical range of Theremin 1.

The Range setting specifies how many octaves, or fractions thereof, Theremin 1 can play given a range of input. The Range setting acts roughly as a scaling factor used by CPU 22 in associating input to output.

Generally, a Theremin generates the tonic of a scale when the musician's hand is placed in a specific root physical location relative to the antenna. As the hand moves with respect to this location, so does the resulting sound of a conventional Theremin. Conventional Theremins play all of the notes of every scale and all of the audio frequencies in between. This makes them very flexible, but also very difficult to play.

In Theremin 1, the Scale setting specifies a limited set of notes that Theremin 1 is permitted to play. By limiting the number of available frequencies to only those within a musician-specified scale, or concentrating them near notes in the scale, the device becomes much easier to use in a more musical way. A very wide range of collections of notes are considered scales for the purpose of this description. For example, "scale" as used herein includes such things as chromatic scale, major diatonic scale, minor pehtatonic scale, the three tones of a major triad, only the root tonic notes, etc. The array of possibilities is very large. The commonality is that the musician may decide to include only those tones that are appropriate to a given performance. In practice, these settings are very likely to change even between songs.

The Snap setting specifies the degree of adherence to the specified scale. Specifying full snap, for example, causes CPU 22 of Theremin 1 to only play the exact scale tones in the exact key as specified in others of the settings. CPU 22 will snap a detected hand position between two notes up or down to the nearest note within the scale. This sets up a many-to-one relationship between hand position and output frequency. A gentler snap setting causes CPU 22 to tend toward these exact notes but still play the frequencies in between. A zero snap setting substantially eliminates the scale functionality, while leaving the octave and other settings in place.

In an illustrative embodiment, 50% snap is defined as follows. CPU 22 translates half of the range of hand positions between note positions into the nearest single output note, taken from within the scale. CPU 22 translates the other half of that range smoothly into the range of frequencies between those two scale toes, using linear interpolation in this illustrative embodiment. The effect of moving one's hand toward the antenna is a slow bending transition between notes with a lingering on the desired scale tones. Other snap settings are also possible, with more or less bending verses lingering behavior for the same input hand gesture. Non-linear interpolation techniques, including splines, are also an appropriate possibility.

The Slew rate setting specifies the maximum rate at which an output frequency is allowed to change. If, for example, the position of the musician's hand indicates a desire to change the output frequency from A to B, the slew rate setting prevents that transition from happening instantly. In particular, CPU 22 limits the rate of change of frequency of the resulting sound to no more than a maximum rate specified in the Slew rate setting. This makes for a smoother sounding performance which may be aesthetically more desirable.

Allowing the musician to choose from a pallet of Waveforms or modify them parametrically is a reasonably common feature in modern electronic keyboards and synthesizers. Use of CPU 22 in Theremin 1 enables use of custom waveforms in an otherwise traditionally analog instrument. The Waveform setting specifies a particular waveform to be used by CPU 22 in producing resulting sounds from detected hand positions.

It is important to take note of a particular challenge in implementing this sort of solution. In the older, non-computerized Theremin designs, the input sensor signal would flow through to the output audio signal through a set of analog electronics. By contrast, in Theremin 1, that chain is broken and a CPU 22 is inserted in between sensor section 10 and output audio generator 24. CPU 22 synthesizes the output audio signal based on signals from sensor section 10 represented detected hand positions and musical settings as described herein. When CPU 22 determines that a change in the output audio signal is needed, it is preferred that CPU 22 preserves the phase of the output audio signal through the required change in frequency. Phase is a measure of position within a cyclic signal. It is often measured in a range from 0 to 360 degrees or 0 to $2\pi$ radians. By changing the frequency while maintaining the output phase, we avoid generating displeasing audible pops in the resulting audio. Preserving phase in a digitally processed waveform is known and not described further herein.

Note that the design of Theremin 1 allows for the introduction of a much wider array of characteristics than those described here. In addition, the invention covers any one of these characteristics alone, as well as, any combination. Further, the invention contemplates that these settings may be modified by the musician at performance time, or fixed in place by the designer.

Sensor

Sensor section 10 (FIG. 1) includes a capacitor 14, a multivibrator 16, and a counter 18. Capacitor 14 is wired in parallel with antenna 12. Multivibrator 16 uses the combination of capacitor 14 and antenna 12 as a load for its oscillator. Counter 18 accumulates the number of oscillations of multivibrator 16 over time. This number, sometimes referred to herein as a count, is periodically read by CPU 22.

Antenna 12 and capacitor 14, collectively, are charged and discharged many thousands of times each second. The collective capacitance of this small system determines how long it takes for each charge/discharge cycle and therefore the ultimate rate of oscillation of multivibrator 16. As the musician's hand approaches antenna 12, the hand's additional capacitance has the effect of slowing the oscillation rate of the system. This oscillation rate can therefore be used as a monotonic measure of the position of the musician's hand to the antenna.

Counter 18 increments once for each oscillation of multivibrator 16. By reading counter 18's count and comparing it against an independent measure of real-time as kept by clock source 20, CPU 22 is able to determine the rate of oscillation of the multivibrator 16. The rate of change of the value in counter 18, is a measure of the rate of oscillation of the multivibrator 16, which is a measure of the total capacitance of the system, which is a measure of the position of the musician's hand with respect to the antenna 12. This process of using a frequency counter to convert the inherently analog hand position into a digital quantity that can be used for further processing, enables many of the important improvements to the Theremin.

Additional embodiments replace the sensor section 10 with alternate forms of position sensor including RC, LC, LRC, sonar, radar, optical, interferometric, electrostatic, electromagnetic, etc. In any event, the output of sensor section 10 should preferably be a monotonic function of the position of the musician's hand with respect to antenna 12 or an alternate detection device. Sensor section 10 sends this output to CPU 22 for processing.

Further embodiments replace the sensor section with any number of other types of sensing devices including knobs, sliders, levers, pickups, vibration sensors, motion sensors, position sensors, electrical contacts, mechanical contacts, etc.

Central Processing

CPU 22 is connected to an external clock source 20 that is, generally speaking, chosen for its accuracy. A tuned quartz crystal similar to those used in battery powered wrist watches is one inexpensive and very accurate option.

CPU 22 periodically reads the number stored in counter 18. The rate at which this number increases relative to the stable clock source 20, is a measure of the frequency of multivibrator 16 and therefore also of the hand's physical position relative to antenna 12.

From this measure, CPU 22 can generate an output signal that specifies an audio frequency that in turn corresponds to the physical position of the user's hand relative to antenna 12. CPU 22 can construct a waveform, having this predominant frequency, which approximates the resulting sound of a conventional Theremin with an antenna and a musician's hand at about the same position.

CPU 22 uses this measure of the position of the musician's hand, and a variety of musician-specified settings, to generate the output signal representing an audio waveform. A wide range of musician-specified behavior can be inserted here as a result of the level of control introduced by CPU 22 in this central position.

The use of Digital Signal Processing (DSP) in a thoroughly analog electrical instrument allows introduction of a finely-regulated amount of control in the ever-wandering analog sound characteristics produced by a Theremin.

A complete program listing is included on CD-ROM that discloses an illustrative embodiment of the software that a PIC microprocessor for CPU 22.

Audio Output

Output audio generator 24, also shown in FIG. 1, includes a digital to analog converter 26 that receives digital output from CPU 22 and creates analog output for an amplifier 28. Amplifier 28, in turn, drives an audio speaker 30.

Additional embodiments replace output audio generator 24 with alternate forms of output, including a MIDI interface or a line-out signal that does not directly require speaker 30. In any event, output audio generator 24 receives input from CPU 22 after processing.

Component Parts

An illustrative embodiment, as constructed, uses a number of specific parts. Although the specific choice or components is somewhat arbitrary in constructing an embodiment of a Fretted Theremin 1, examples of components used in an illustrative embodiment consistent with the foregoing description are listed in the following paragraph.

Antenna 12 is a brass rod, chosen for its conductivity and aesthetic appearance. Capacitor 14 is made of mica, chosen for its thermal stability. Multivibrator 16 is a LMC555CN, chosen of is stability and operational frequency. Resistive components associated with multivibrator 16 are metal film resistors, also chosen for their thermal stability. Note that these resistors are connected in multivibrator 16, in a very standard sub-assembly and are not specifically illustrated in the figures. A PIC 18F2320 is a single package integrated circuit that contains counter 18, CPU 22, and digital to analog converter 26. Internal audio amplifier 28 is a TL071. An illustrative embodiment, as constructed, uses a secondary amplifier (not illustrated) along with speaker 30, combined into a single package as a Marshall Valvestate combination amplifier/speaker.

In addition to the core components described above, an illustrative embodiment, as constructed, also includes a dual-seven-segment LED display and rotary encoder for communicating with the musician. These components are also not illustrated here.

Figure 2:
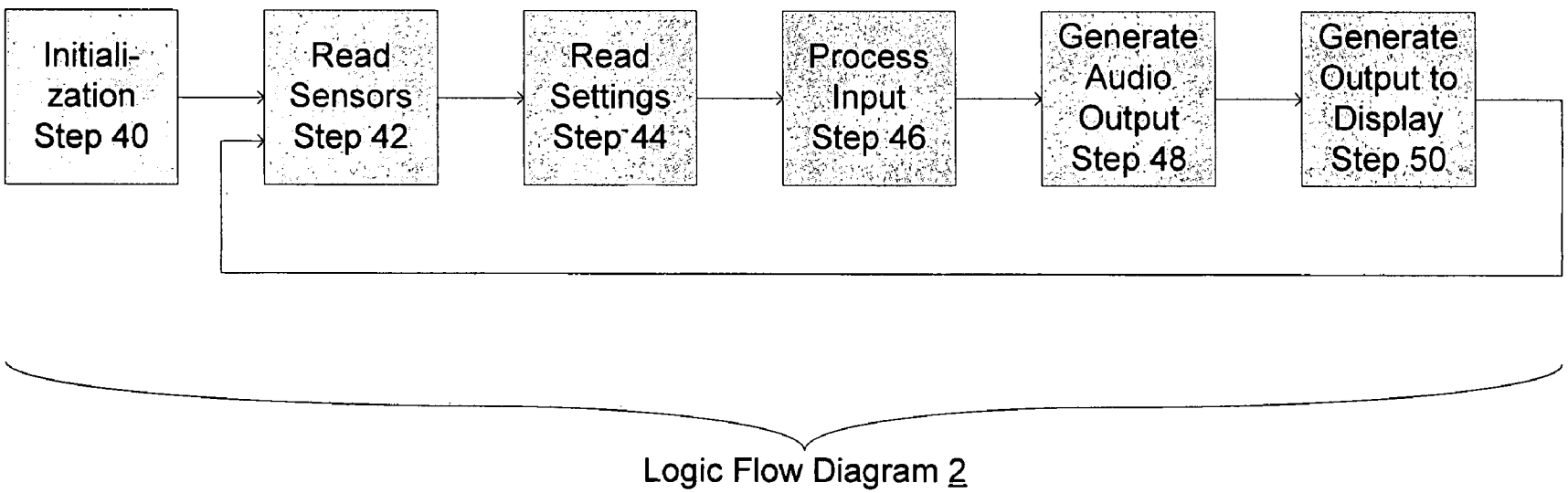
FIG. 2 is a logical flow diagram showing the flow of control within CPU 22 of FIG. 1.

Overview of FIG. 2, Control Flow

FIG. 2 shows a Logic Flow Diagram 2 of an illustrative embodiment of the software operation of the invention. When Theremin 1 is first turned on, CPU 22 performs an initialization step 40. Initialization step 40 prepares Theremin 1 for operation and calibrates sensor section 10. Sensor section 10 is responsible for measuring the capacitance introduced by a musician's hand as s/he plays Theremin 1.

As said earlier, sensor section 10 is designed to measure small variations in capacitance as the musician's hand position varies in relation to antenna 12. It should be noted that this change in capacitance is very slight and susceptible to external factors such as ambient temperature or humidity as well as the body mass of the musician. For this reason, CPU 22 performs an automated calibration routine to correct for these variations by measuring the system capacitance when the Theremin 1 is not being played. In this illustrative embodiment, a musician initiates calibration of sensor section 10 while standing a position from which the musician intends to play Theremin 1 with her hands at her side or otherwise not in playing proximity to antenna 12. Calibration can be initiated by pressing a button or by any other user input gesture that is recognizable by CPU 22 as a command to calibrate sensor section 10. In response, CPU 22 measures the capacitance of sensor section 10 as a base capacitance. Measured variations from this base capacitance are interpreted by CPU 22 to be the result of position of the musician's hand in relation to antenna 12.

After initialization step 40, CPU 22 cycles through the following five other steps: read sensors step 42, read settings step 44, process input step 46, generate audio output step 48, and generate output to the display step 50. In read sensor step 42, CPU 22 receives information about the proximity of a musician's hand as s/he plays Theremin 1. In one embodiment, CPU 22 receives a count from counter 18 of the number of oscillations of multivibrator 16 with a capacitive load made up of load capacitor 14 and the musician's hand. The difference in the count received from counter 18 at two successive reading is a measure of counter 18's frequency and therefor also of the proximity of a musician's hand to the Theremin 1.

In read settings step 44, CPU 22 receives information about the settings that the musician and/or designer would like to apply to the final audio sound generated by Theremin 1. These settings can include a specification about what musical scale to play in, or how strongly to snap an output tone to one of the notes in the scale as described above.

In process input step 46, CPU 22 calculates the digital representation of an audio output signal based on the proximity of a musician's hand, received in read sensor step 42, and Theremin 1's settings, received in read settings step 44.

In generate audio output step 48, CPU 22 converts the digital representation of an audio output into an output waveform to send to Amplifier 28.

In generate output to display step 50, CPU 22 controls the status of display lights on the LED display.

After waiting a fixed period of time, CPU 22 proceeds to repeat the sequence of steps, beginning again with read sensors step 42.

Additional embodiments fix settings such that read setting step 44 always returns static values and/or don't make use of a display such that generate output to the display step 50 is not needed. Still further embodiments have CPU 22 performing these steps in alternate orders, with additional steps, or at alternate frequencies.

Figure 3:
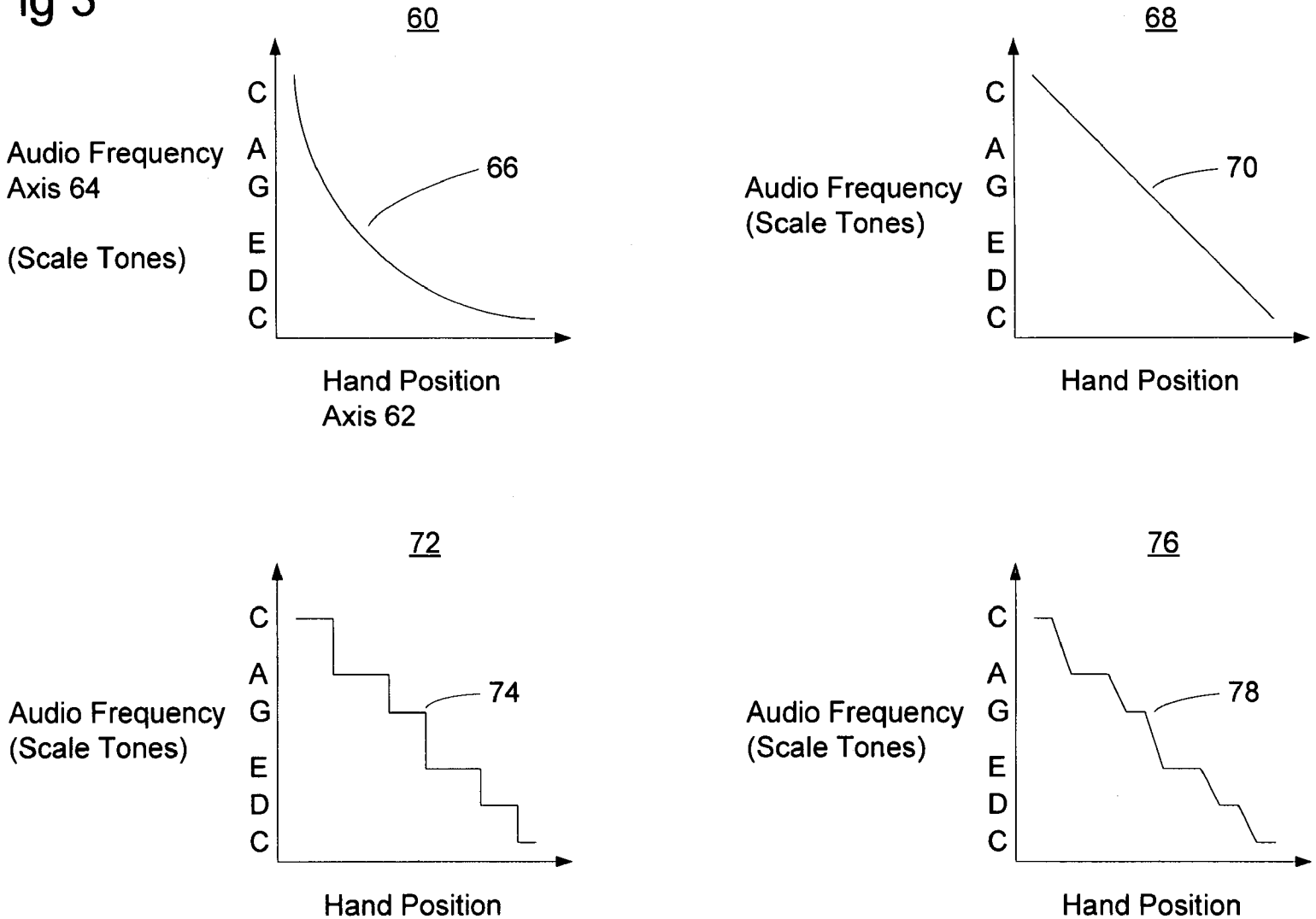
FIG. 3 includes a number of charts showing the relationship between hand position and audio frequency during play of the Theremin of FIG. 1.

Overview of FIG. 3 Transfer Function

FIG. 3 shows several possible relationships between the position of a musician's hand with respect to antenna 12 and audio frequency. The differences help to illustrate several advantages of Theremin 1.

Natural transfer graph 60 shows a relationship between the position of the musician's hand and an output frequency if CPU 22 approximates the frequency response of a conventional Theremin with little or no modification of the input signal received from sensor section 10. Hand position axis 62 is plotted along the horizontal axis. Output frequency axis 64 is plotted along the vertical axis. The transfer function 66 shows the relationship between the position of the musician's hand and the output frequency of the device. As the hand approaches the antenna 12, it moves left on the horizontal hand position axis 62 of the graph. As the hand approaches, the instrument's output frequency can be seen to increase along the output frequency axis 64. Thus, the plot tends to go from the upper left to the lower right of the graph. The natural transfer function 66 shown here is approximate and depends a great deal on the physical configuration of the system and its antenna 12.

Normalized transfer graph 68 also shows a relationship between the position of the musician's hand and an output frequency in an embodiment in which CPU 22 normalizes the relationship between hand-antenna proximity and the resulting audio frequency. CPU 22 performs this normalization in process input step 46. The axes of this graph are the same as seen in the natural transfer graph 60, but the normalized transfer function 70 is different. In this case, the transfer function has been transformed by CPU 22 to be more linear. As the hand approaches the antenna 12, CPU 22 still causes an increase in output frequency, but in a more natural, predictable manner. This smoother, more predictable transfer function is much easier of a novice musician to work with and less susceptible to fluctuations in ambient temperature or humidity. This is made possible by the introduction of control between the sensor and output sections. This level of control is enabled by causing the thoroughly analog proximity signal to exist in an intermediate digital form where it can be manipulated by digital processes before the signal is converted back to the thoroughly analog audio output signal. Note that, with various configurations of CPU 22 and its behavior, the axes many be inverted, linear, logarithmic, or made into any number of other forms, depending on the desired playing style of the performer.

Scaled transfer graph 72 also shows an relationship between the position of the musician's hand and an output frequency in an embodiment in which CPU 22 requires that all output frequencies be precise tones of a pre-defined scale. CPU 22 performs this snapping to scale tones in process input step 46. The axes of this graph are again the same as in natural transfer graph 60, but the scaled transfer function 74 is quite different. It has again been transformed by CPU 22 to adhere to the C major pentatonic scale. As the hand approaches the antenna 12, CPU 22 causes the output frequency to step successively through the tones of the C major pentatonic scale: C, D, E, G, A, and then back up to the next higher C note. Thus, many different electrical signals received by CPU 22 corresponding to many specific hand positions of the musician map to one resulting audio signal as a result of this snapping.

Accordingly, the range of acceptable hand positions that will yield one of these five selected notes has thus been substantially broadened with regard to transfer function 70 or transfer function 66. While all songs obviously can not be played using only these few notes, simple tunes such as "Mary Had a Little Lamb" and "Three Blind Mice" are made much easier to render on Theremin 1 without the possibility of playing notes outside of this basic scale. It should be noted that there are only a very small number of musician's in the world who are able to reliably perform even these simple tunes on a conventional Theremin without benefit of the improvements described in this patent.

Soft snap transfer graph 76 also shows an relationship between the position of the musician's hand and an output frequency in an embodiment in which CPU 22 tends to require that output frequencies be tones of a pre-defined scale, albeit less strictly. CPU 22 performs this soft-snapping to scale tones in process input step 46. The axes of this graph are once again the same as in natural transfer graph 60, but the soft snap transfer function 78 is different. It can be seen to focus on the same notes shown in the scaled transfer function 74, but there are now softer slopes between the notes. These sloped sections represent a biasing of the audio signal to notes of the selected musical scale, still facilitating musicality of the resulting audio signals while also allowing the more accomplished performer to slide or bend through audio frequencies that lie between scale tones.

There are a great many possible scales and degrees of snap or glissando that are possible using the improvements described herein. In addition, some styles of playing emphasize bending some scale tones more than others. Although beyond the scope of this document, these sorts of features are all also made possible by the innovations described herein.

Conclusions, Ramifications, and Scope

By introducing control over these musical characteristics, a conventional Theremin is converted from an atonal noise maker into a finely tuned musical instrument. The advancement of this invention is analogous to the addition of a guitar-style fret board to a single string, broomstick and wash-bucket bass.

While the above description contains many specifics, these should not be construed as limitations on the scope of the invention, but rather as an exemplification of one preferred embodiment thereof. Many other variations are possible.

Accordingly, the scope of the invention should be determined not by the embodiments illustrated, but by the appended claims and their legal equivalents.

I claim:

1. An instrument that comprises:

a sensor that:

determines a performer's gesture in the absence of physical contact between the sensor and the performer and converts the intent into an electrical signal, and digital logic that is operatively coupled to the sensor and that receives the electrical signal from the sensor and transforms the electrical signal into an audio signal that can be audibly presented to a listener;

where the digital logic biases the audio signal toward notes of a musical scale;

where a degree of the bias is selected by the performer.

2. An instrument as described in claim 1 wherein the sensor is configured to determine the intent of the human user by sensing the position of a part of the body of the human user relative to the sensor.

3. An instrument as described in claim 2 where the digital logic is configured to calibrate the sensor.

4. An instrument as described in claim 2 where the sensor is a proximity sensor.

5. An instrument as described in claim 2 where the sensor includes a capacitance sensor.

6. An instrument as described in claim 1 where the digital logic substantially alters the transfer function of the electrical signal into the audio signal.

7. An instrument as described in claim 6 where the transfer function is discontinuous.

8. An instrument as described in claim 1 where the musical scale is selected from a group consisting essentially of chromatic, diatonic, whole tone, and pentatonic.

9. An instrument as described in claim 1 where the musical scale is selected by the performer.

10. An instrument comprising:

a sensor for determining a performer's intent in the absence of physical contact wherein the sensor produces an electrical signal, digital logic that is operatively coupled to the sensor and that receives the electrical signal from the sensor and produces, using the electrical signal, an audio signal that can be audibly presented to a listener, and transforming logic that is operatively coupled to the digital logic and that causes the digital logic to bias the audio signal toward notes of a musical scale;

where a degree of the bias is selected by the performer.

11. A process for producing an audible waveform, the process comprising:

sensing the position of a part of the body of a human user in the absence of physical contact between the part and any sensor, calculating an output frequency based on the position, and generating the audible waveform having the output frequency as a predominant frequency;

where the calculating biases the output frequency toward frequencies of a musical scale;

where a degree of the bias is selected by the human user.

12. A process as described in claim 11 where the process is repeated 2 or more times per second.

13. A process as described in claim 11 that makes changes in the output frequency in such a way so as to preserve the phase of the audible waveform.

* * * * *